US005463882A

United States Patent [19]

Yeh

[11] Patent Number: 5,463,882

[45] Date of Patent: Nov. 7, 1995

[54] CIRCULAR KNITTING MACHINE WITH CUT PILE MECHANISM

[75] Inventor: Tzu-Pin Yeh, Miao Li Hsien, Taiwan

[73] Assignee: Pai Lung Machinery Mill Co., Ltd., Taipei, Taiwan

[21] Appl. No.: 233,250

[22] Filed: Apr. 26, 1994

[51] Int. Cl.[6] ..... D04B 9/06

[52] U.S. Cl. ..... 66/92; 66/90

[58] Field of Search ..... 66/13, 17, 19, 66/25, 91, 92, 104, 93

[56] References Cited

U.S. PATENT DOCUMENTS

| | | | |
|---|---|---|---|
| 3,041,859 | 7/1962 | Andersen et al. | 66/92 |
| 3,879,962 | 4/1975 | Mahler | 66/92 |
| 4,127,013 | 11/1978 | Nuber | 66/92 |
| 4,592,212 | 6/1986 | Schmidt | 66/91 |

FOREIGN PATENT DOCUMENTS

| | | | |
|---|---|---|---|
| 0082538 | 6/1983 | European Pat. Off. | 66/91 |
| 62-184157 | 8/1987 | Japan | 66/91 |

*Primary Examiner*—C. D. Crowder
*Assistant Examiner*—Larry D. Worrell, Jr.
*Attorney, Agent, or Firm*—Bacon & Thomas

[57] ABSTRACT

A circular knitting machine includes a loop cutting mechanism to cut the loops made by the relative movement of the dial needles and cylinder needles, the loop cutting mechanism including a first sinker and a second sinker reciprocated horizontally along two opposite sides of either cylinder needle at a time difference, the first sinker having a smooth front sloping end moved to hold down the loop, the second sinker having a front sloping end turned sideways toward the first sinker and moved along the respective cylinder needle at an opposite side after the first sinker to cut the loop.

1 Claim, 7 Drawing Sheets

CIRCULAR KNITTING MACHINE WITH CUT PILE MECHANISM

BACKGROUND OF THE INVENTION

The present invention relates to a circular knitting machines, and more particularly to an improved structure of loop cutting mechanism for a circular knitting machine for the production of towelings.

Various circular knitting machines are known, and widely used for, the production of towelings. Because these circular knitting machines have various drawbacks including short service life and high frequency of cutting errors, the present inventor disclosed a circular knitting machine cut pile and cylinder arrangement and filed on Jan. 5, 1994 under application Ser. No. 08/177,455 which eliminates the drawbacks of the conventional circular knitting machines by means of reciprocating two sinkers along two opposite sides of the cylinder needle synchronously. This arrangement is functional and can greatly prolong the service life of the circular machine, however it produces yarn chips during the loop cutting operation.

SUMMARY OF THE INVENTION

The present invention is an improvement made on the circular knitting machine cut pile and cylinder arrangement disclosed in U.S. patent application Ser. No. 08/177,455. According to one aspect of the present invention, the loop cutting mechanism comprises a first sinker and a second sinker reciprocated horizontally along two opposite sides of either cylinder needle at a time difference the first sinker having a smooth front sloping end moved to hold down the loop, the second sinker having a front sloping end turned sideways toward the first sinker and moved along the respective cylinder needle at an opposite side after the first sinker to cut the loop. According to another aspect of the present invention, the dial of the dial unit of the circular knitting machine has a plurality of nose tips spaced around the border thereof, each nose tip having a tip end disposed in vertical and a slope extended downwardly inwards from the tip end for guiding the base yarn and the inlay yarn, causing the inlay yarn to form into loops on the front side of the fabric being made and the base yarn to form the back structure of the fabric.

BRIEF DESCRIPTION OF THE DRAWINGS

The present invention will now be described by way of example with reference to the annexed drawings in which.

DETAILED DESCRIPTION OF THE PREFERRED EMBODIMENTS

Figure 2:
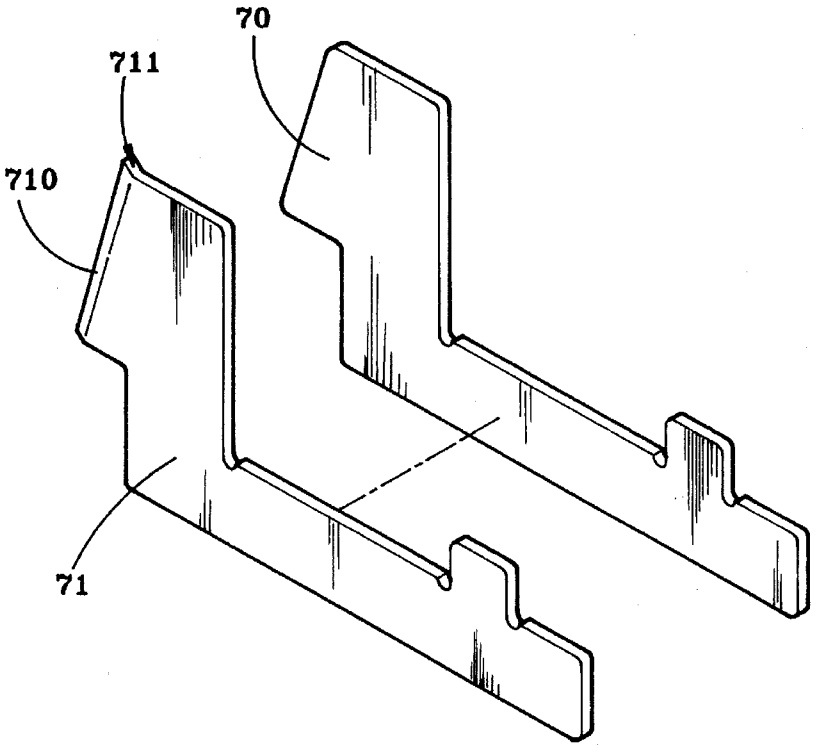
FIG. 2 is an elevational view of a first sinker and a second sinker according to the present invention.
Figure 1B:
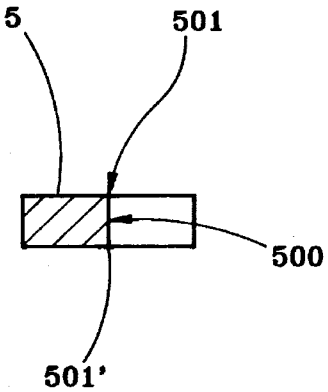
FIG. 1B is a sectional view taken on line 1B—1B of FIG. 1A.
Figure 1A:
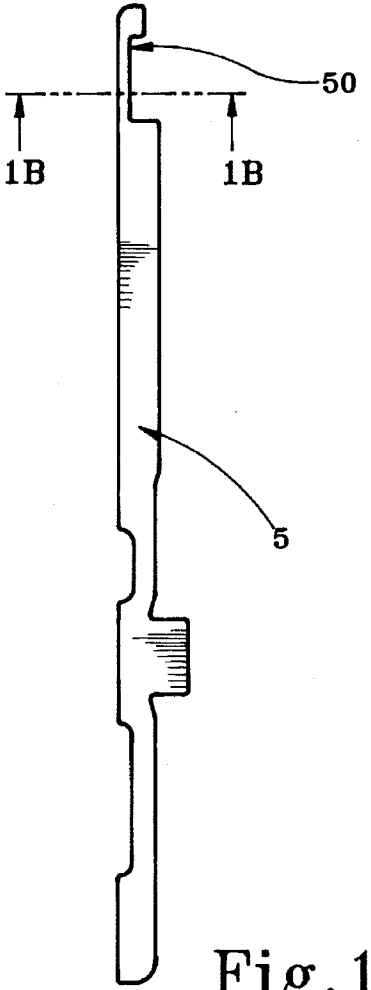
FIG. 1A shows a cylinder needle according to the present invention.
Figure 3:
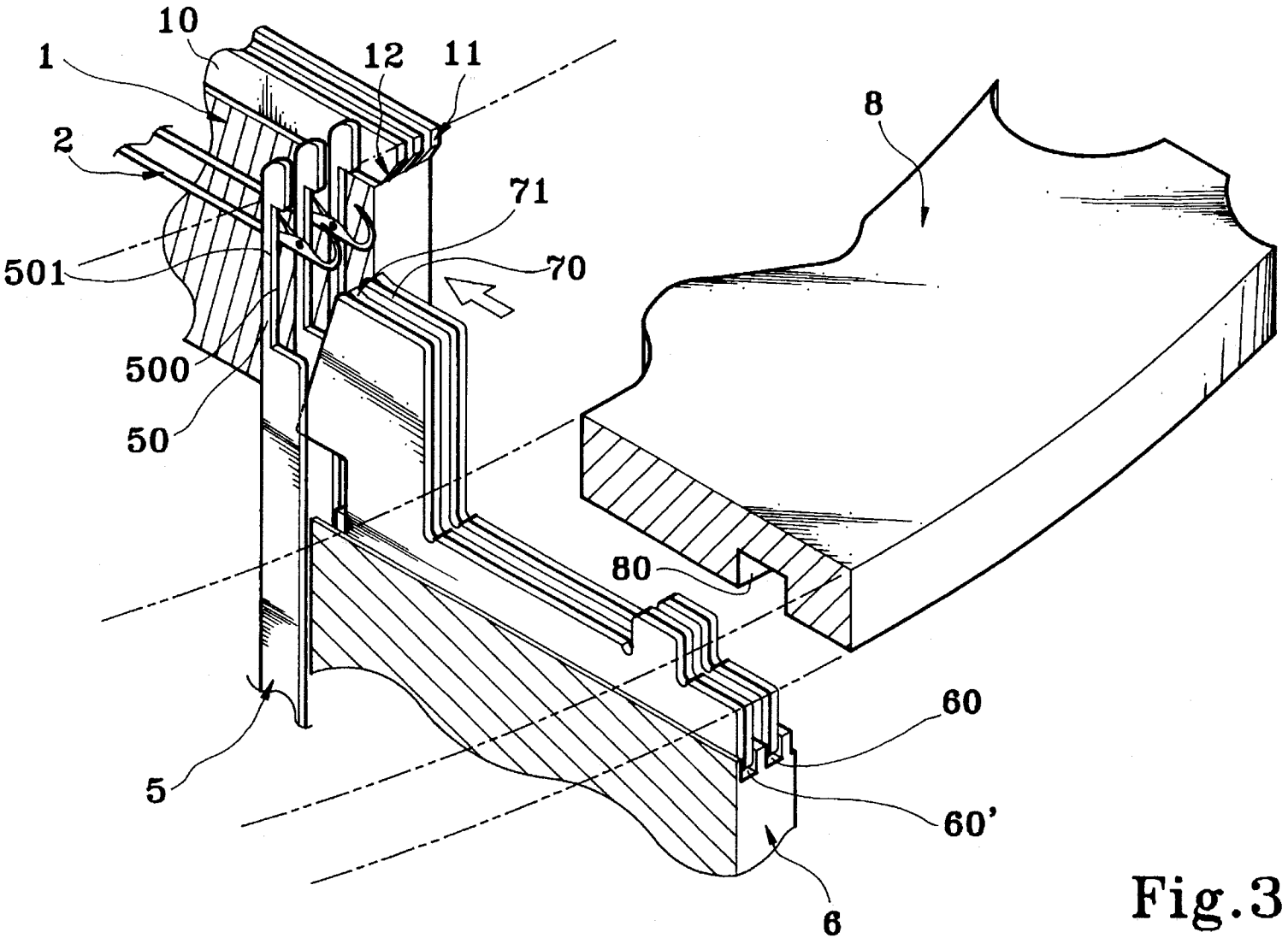
FIG. 3 shows the arrangement of the cylinder, dial needles, cylinder needles, and sinkers according to the present invention.
Figure 4:
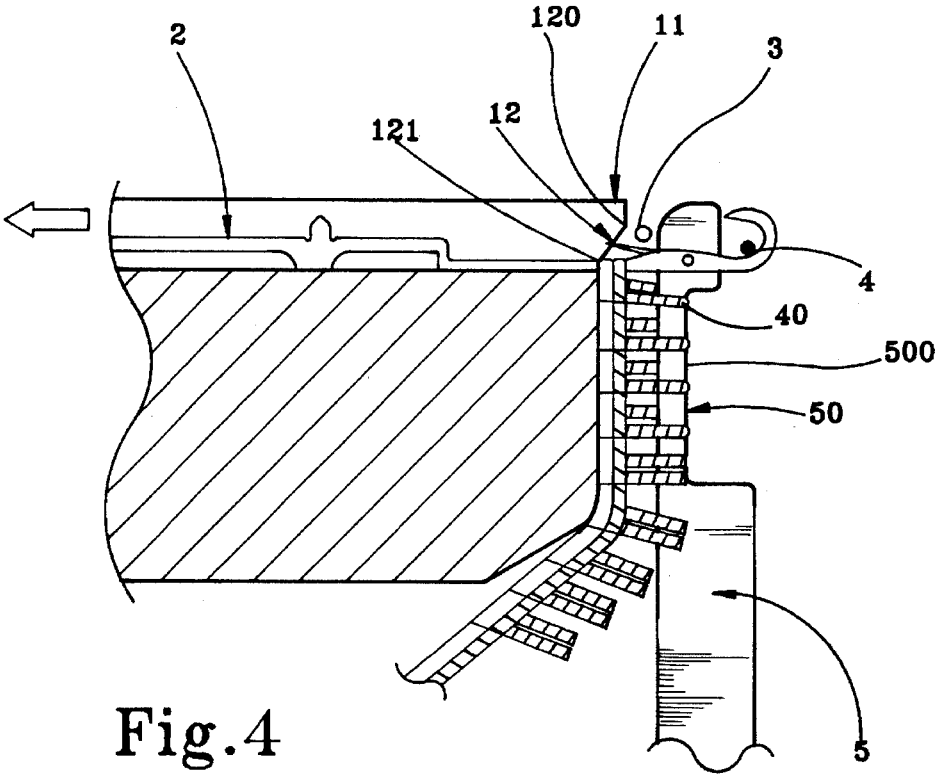
FIG. 4 shows the operation of the circular knitting machine of the present invention in making loops (Part I; the dial needle fully extended out)
Figure 5:
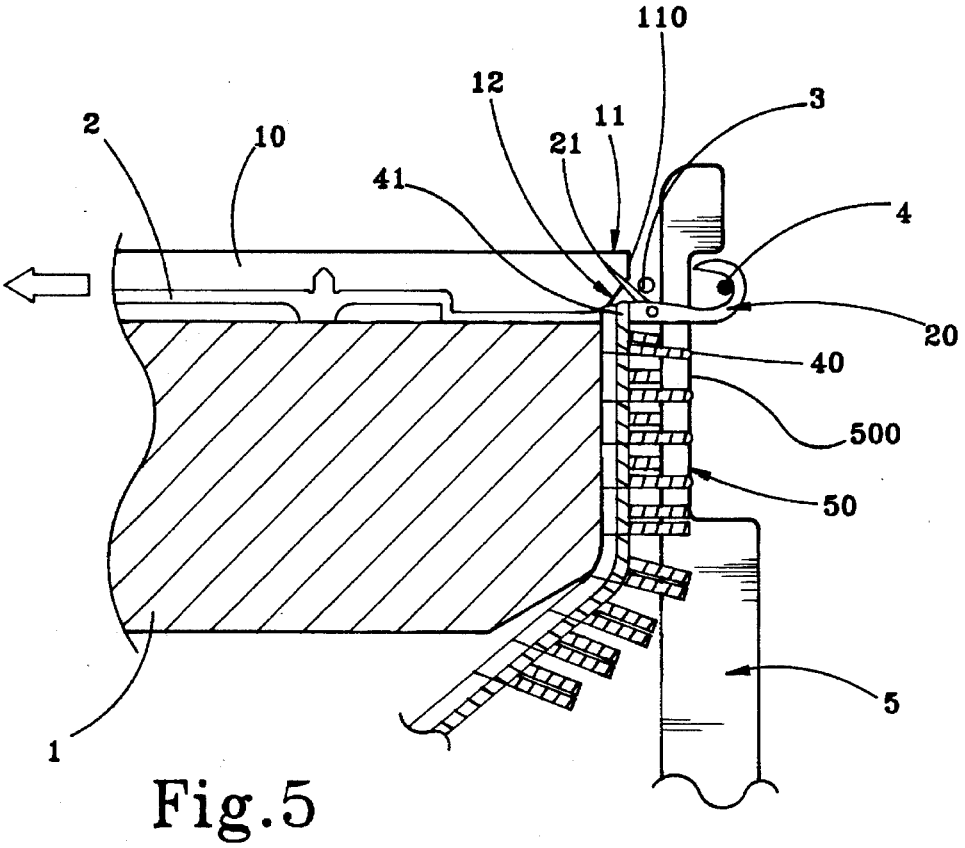
FIG. 5 is similar to FIG. 4 but showing the backward stroke of the dial needle in hooking the inlay yarn (Part II)
Figure 6:
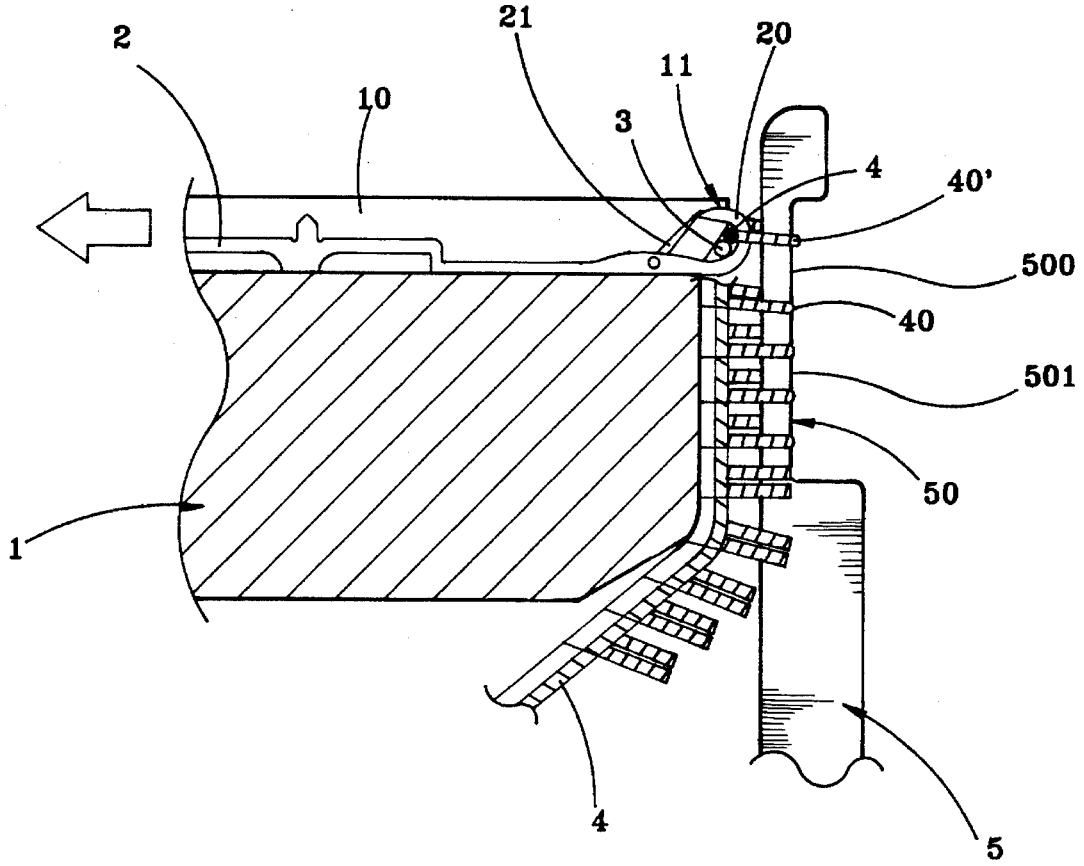
FIG. 6 is similar to FIG. 5 but showing the dial needled moved fully moved back and a loop formed on the cylinder needle.

Referring to FIGS. 2 and 3, the knitting elements of a circular knitting machine for knitting yarns into a fabric in accordance with the present invention is comprised of a dial unit and pile element unit. The dial unit, as shown in FIG. 3, comprises a dial 1, and dial needles 2 made to slide in radial dial grooves 10 on the dial 1. The dial needles 2 are reciprocated in the radial dial grooves 10 by the cam of the circular knitting machine to match with the vertically reciprocated cylinder needles 5 of the pile element unit in making yarns into loops for making a fabric. The dial i has a nose tip 11 disposed at either side of the outer end of either radial dial groove 10. The nose tip 11 has a tip end 110 disposed in vertical (in parallel with the longitudinal axis of the knitting machine), which coincides with the moving direction of the hook of the dial needle 2 in hooking the inlay yarn 4, and a slope 12 extended downwardly inwards from the tip end 110, which coincides with the moving direction of the hook of the dial needle 2 in setting a loop. The difference of elevation between the top end 120 of the slope 12 and the bottom end 121 thereof covers the position of the base yarn 3 (see FIG. 4). The production of cut pile is explained hereinafter with reference to FIGS. 4, 5, and 6.

i) As shown in FIG. 4, when the dial needle 2 is fully extended out, the cylinder needle 5 is disposed at the lowest position with the cut 50 thereof downwardly hooked on the loop 40 just made, and at the same time, the base yarn 3 and the inlay yarn 4 are guided to the hook 20 of the dial needle 2 and disposed at two opposite sides by the cylinder needle 5, permitting the inlay yarn 4 to be disposed at a higher elevation than the cut 50 on the cylinder needle 5.

ii) As shown in FIG. 5, when the dial needle 2 starts to move back toward the left, the cylinder needle 5 starts to move upwards over the elevation of the inlay yarn 4 for permitting the inlay yarn 4 to be attached to the cut 50, and at the same time, the latch 21 of the dial needle 2 is forced by the previously made loop 40 to close the hook 20 of the dial needle 2.

iii) As shown in FIG. 6, when the dial needle 2 is received back to the left, a new loop 40' is made around the cut 50 of the cylinder needle 5, and the base yarn 3 is guided downwards by the slope 12 to become disposed at an elevation below the base yarn 4, and therefore the inlay yarn 4 forms the new loop 40' on the front side of the fabric being made and the base yarn 3 forms the back structure of the fabric. Therefore, the fabric is a toweling.

Referring to FIG. 3 again, the pile element unit which cuts the aforesaid loop 40 is comprised of the aforesaid cylinder needle 5, and a pair of sinkers 70;71 received in two adjacent radial sliding grooves 60 on the sinker ring 6 of the knitting machine at two opposite sides by the cylinder needle 5 and reciprocated in the horizontal direction. The two sinkers 70;71 are reciprocated by a cain 8 to pass through the cylinder needle 5 at either side at a time difference and than to cut the loop 40 on the cut 50 of the cylinder needle 5.

The aforesaid cylinder needle 5 has a cut 50 facing the sinkers 70;71. The cut 50 covers the inlay yarn 4 feeding point when the cylinder needle 5 is moved to the upper limit, so that the inlay yarn 4 can be stopped and formed into a loop 40 upon each cycle of the reciprocating movement of the dial needle 2 (see FIG. 6). When the cylinder needle 5 is moved to the lower limit, the cut 50 must be disposed at a lower elevation than the dial needle 2, so that the duly formed loop 40 can be pulled tight and then cut by the sinkers 70;71. The aforesaid cut 50 comprises a plain front side 500 having two symmetrical side edges 501;501' at right angles.

Figure 7:
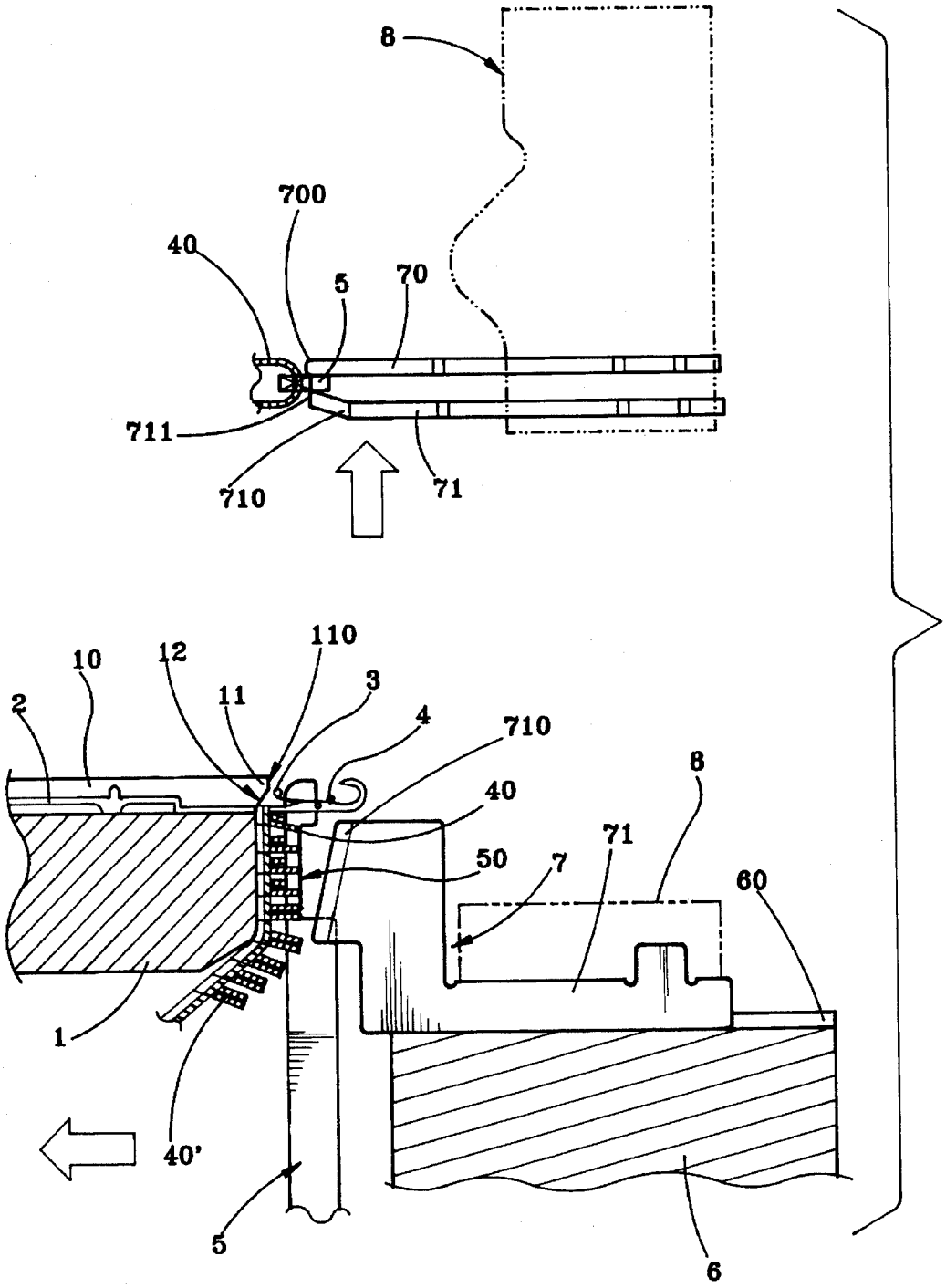
FIG. 7 shows the loop cutting operation of the sinkers (Part I)

The sinkers 70;71, namely, the first sinker 70 and the second sinkers 71 are respectively made from a flat metal plate having a front end sloping forwards downwards. The front sloping end 700 of the first sinker 70 is made smooth. When the front sloping end 700 of the first sinker 70 passes over one side of the cylinder needle 5, as shown in FIG. 7, it is closely attached to and moved along the cylinder needle 5. The front sloping end 710 of the second sinker 71 is bent sideways and formed into a plain edge 711 facing the first sinker 70 and disposed in parallel with the front side 500 of the cut 50 on the dial needle 2. When the second sinker 71 is moved toward the cylinder needle 5, the plain edge 711 of the second sinker 71 is moved along one side of the cut 50, and therefore the loop 40 is cut by the relative movement between the front side 500 of the cut 50 and the plain edge 711 of the second sinker 71.

Figure 8:
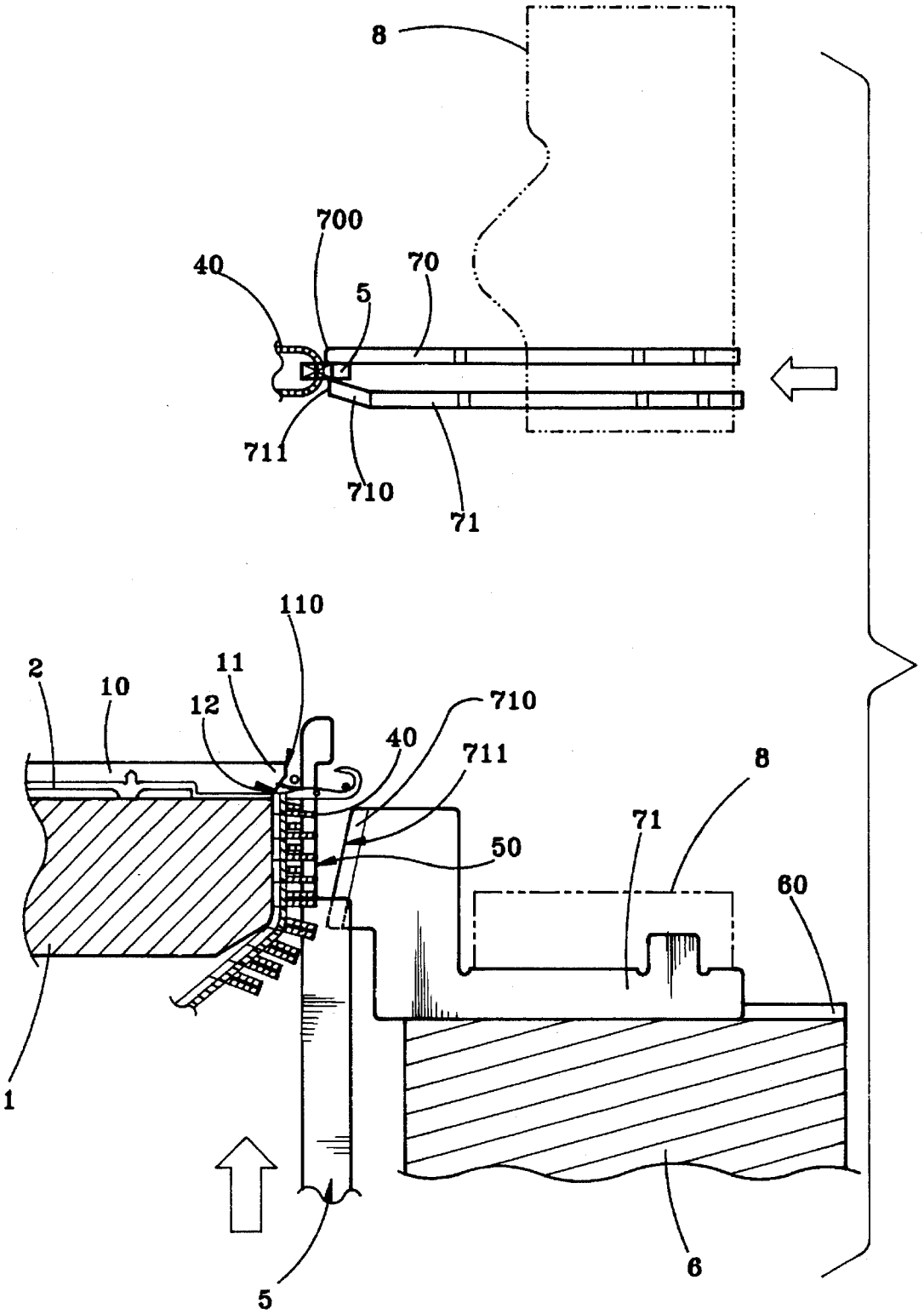
FIG. 8 is similar to FIG. 7 but showing the sinkers extended out (Part II)
Figure 9:
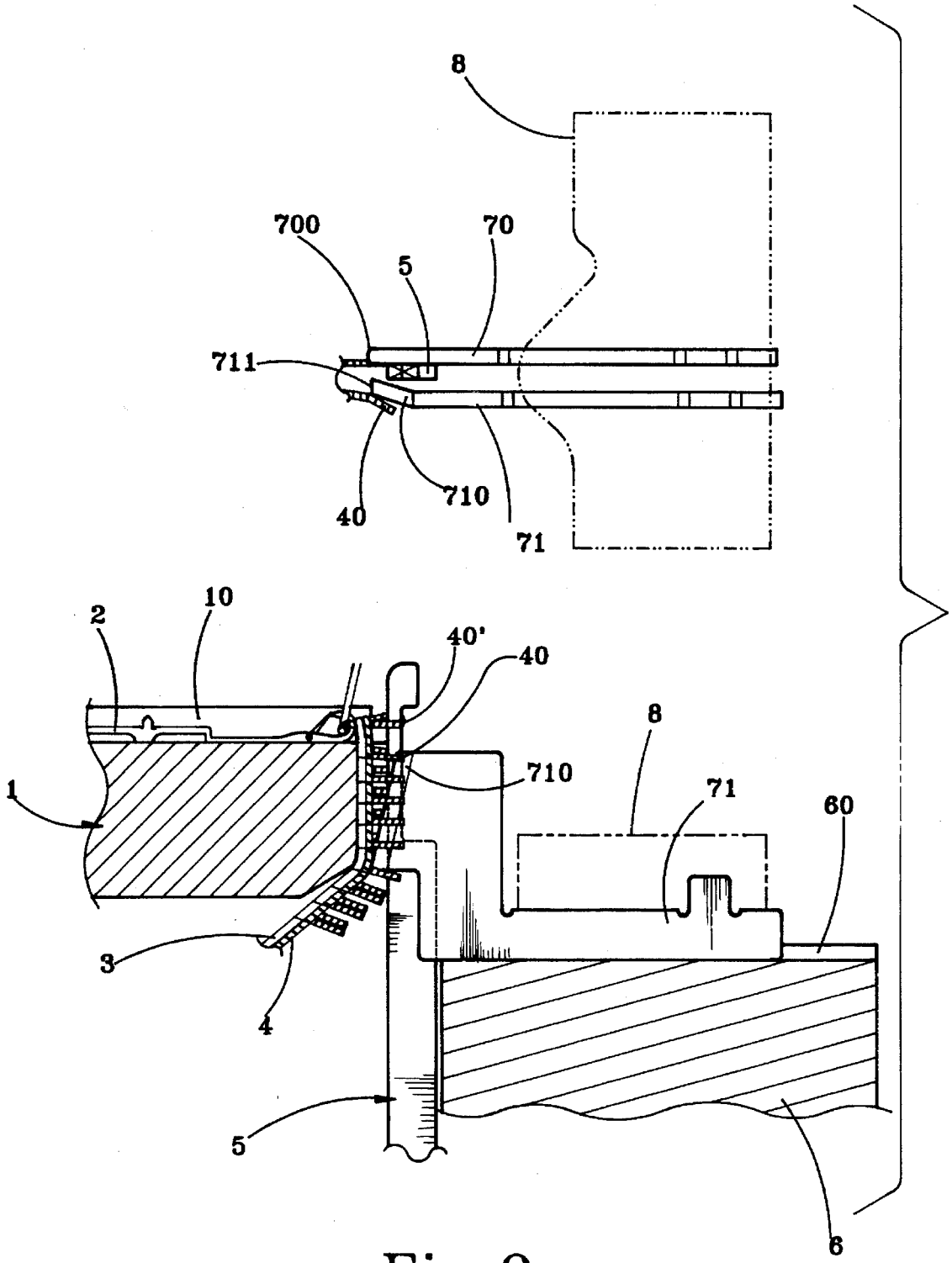
FIG. 9 is similar to FIG. 8 but showing the loop cut by the second sinker (Part III).

The aforesaid first and second sinkers 70;71 are arranged in clockwise direction in each two adjacent radial sliding grooves 60 on the sinker ring 6 of the knitting machine, and each cylinder needle 5 works to match a respective set of sinkers consisting of one first sinker 70 and one second sinker 71, therefore one first sinker 70 and one second sinker 71 of different sets of sinkers are received in each radial sliding groove 60. The operation of the pile element unit is outlined hereinafter.

i) As shown in FIG. 7, when the dial needle 2 is completely extended out (same as the position shown in FIG. 4), the sinkers 70;71 are completely received back (the right limit position).

ii) As shown in FIG. 8, when the cylinder needle 5 and the sinkers 70;71 are moved during the counter-clock wise rotation of the dial 1 and the sinker ring 6, the cam 8 does not move, and therefore the first sinker 70 is forced by the specially designed track 80 of the cam 8 to move toward the cylinder needle 5 before the second sinker 71, causing the front sloping edge 700 moved along one side of the cylinder needle 5.

iii) As shown in FIG. 9, when a loop 40 is formed as the dial needle 2 is moved backwards, the sinkers 70;71 are moved along two opposite sides of the cylinder needle 5, causing the front sloping end 700 of the first sinker 70 to hold down the loop 40 and the plain edge 711 of the second sinker 71 to move over one angled edge 501 of the cut 50 in cutting off the loop 40.

I claim:

1. A circular knitting machine for producing cut pile fabric, comprising: a dial having a plurality of radial grooves; a cam; a plurality of dial needles reciprocated horizontally in the radial dial grooves on said dial by the cam; a plurality of cylinder needles reciprocated vertically to act with said dial needles to make yarns into loops; and a loop cutting mechanism moved to cut said loops, wherein each cylinder needle has a cut comprising a plain front side having two opposite symmetrical edges disposed at right angles to the front side; said loop cutting mechanism comprising a plurality of pairs of sinkers, each pair of sinkers comprising a first sinker and a second sinker reciprocated horizontally along two opposite sides of each cylinder needle, said first and second sinkers each having a respective front sloping end sloping outwardly in a downward direction, the front sloping end of said first sinker having smooth surface moving along one side of the respective cylinder needle as the cylinder needle is lifted, the front sloping end of said second sinker being laterally bent into a plain edge facing said first sinker and disposed adjacent to the front side of the cut on the respective cylinder needle, the plain edge of the front sloping end of said second sinker moving along one side of the cut on the respective cylinder needle to cut the loop when the respective cylinder needle is lifted.

* * * * *